US006611960B2

(12) United States Patent
Kim

(10) Patent No.: US 6,611,960 B2
(45) Date of Patent: Sep. 2, 2003

(54) TWO-PLY NECK COLLAR AND METHOD FOR MAKING SAME

(76) Inventor: Chin-Young Kim, 1885 S. Oswego St., Aurora, CO (US) 80012

( * ) Notice: Subject to any disclaimer, the term of this patent is extended or adjusted under 35 U.S.C. 154(b) by 0 days.

(21) Appl. No.: 10/001,053

(22) Filed: Nov. 15, 2001

(65) Prior Publication Data

US 2002/0062513 A1 May 30, 2002

Related U.S. Application Data

(60) Provisional application No. 60/253,735, filed on Nov. 29, 2000.

(51) Int. Cl.[7] ..... A41B 3/00
(52) U.S. Cl. ..... 2/129; 2/127; 2/115
(58) Field of Search ..... 2/129, 60, 98, 2/116, 130, 131, 132, 133, 134, 135, 136, 137, 138, 139, 140, 141.1, 141.2, 142, 468, 115, 69, 80, 83, 127, 244, 246, 400–408, 220, 221, 238, 236

(56) References Cited

U.S. PATENT DOCUMENTS 1,101,758 A * 6/1918 McKay
1,960,312 A * 5/1934 Landorf ..... 2/133
2,750,595 A * 6/1956 Hollinger ..... 2/113
3,328,808 A * 7/1967 Ambrose ..... 2/127
3,380,075 A * 4/1968 Marthinsson ..... 2/126
3,628,192 A * 12/1971 Artz, Sr. ..... 2/130
4,047,400 A * 9/1977 Thorneburg ..... 66/171
4,603,440 A * 8/1986 Hale ..... 2/115
D290,904 S * 7/1987 Crouch ..... D2/602
4,780,912 A * 11/1988 Harmsen ..... 2/91
4,975,982 A * 12/1990 Hughes ..... 2/49.1
6,026,514 A * 2/2000 Fricker ..... 2/209.11
6,044,498 A * 4/2000 Schumann et al. ..... 2/468
6,138,282 A * 10/2000 Follese ..... 2/400
D438,365 S * 3/2001 Mattrasingh ..... D2/841
6,314,581 B1 * 11/2001 Bond ..... 2/129
6,477,713 B2 * 11/2002 Krause et al. ..... 2/129

* cited by examiner

*Primary Examiner*—John J. Calvert
*Assistant Examiner*—Alissa L. Hoey

(57) ABSTRACT

A neck collar and method are described for a two-ply neck collar for attachment to a neck opening of a garment body to help maintain a proper shape along the neck line. In one embodiment, the two-ply neck collar is made of two strips of knitted fabric material. The two strips of fabric material is sewn together along the top edge portions thereof such that one strip is lying flat against the other strip to form a joined unit. The joined unit is then opened flat to define two side edge portions with the stitched portion disposed extending longitudinally between to the two side edge portions. The joined unit is folded after being opened flat such that the two side edge portions are aligned with the stitched portion facing outward, after which, the two side edge portions are sewn together to form a tubular unit. Finally, the neck collar is formed by turning at least a portion of the tubular unit over the stitched portion.

20 Claims, 6 Drawing Sheets

TWO-PLY NECK COLLAR AND METHOD FOR MAKING SAME

CROSS-REFERENCE TO RELATED APPLICATION

This application claims the benefit of U.S. provisional patent application Ser. No. 60/253,735, filed Nov. 29, 2000, which is incorporated herein by reference.

BACKGROUND OF THE INVENTION

1. Field of the Invention

The present invention generally relates to clothes, and, in particular, to a neck collar to be attached to the neck opening of a shirt body and a method of making the neck collar.

2. Description of the Related Art

Typically, a circular neck collar or neck band is attached to the neck opening of a shirt body (e.g., T-shirt, sweat shirt) to help maintain proper shape along the neck line. Currently, only one layer of fabric (e.g., rib knit band) is typically used to form a circular collar for shirts. The preexisting one-ply neck collar such as the rib knit neck band suffer from various disadvantages. For example, the preexisting one-ply neck collar tends to weaken after each wash, decreasing its ability to maintain proper shape along the neck line and prematurely giving the shirt aged appearance. Moreover, because one-ply circular neck collar is relatively thin around its upper edge, this thin peripheral edge of the neck collar can irritate the skin around the neck area of the wearer, causing discomfort.

SUMMARY OF THE INVENTION

Thus, there is a particular need for a neck collar that is durable and provide comfort to the wearer. In particular, there is a need for a neck collar with two-ply construction to enhance the comfort and quality of the neck collar.

The present invention is directed to a neck collar and method of making thereof for a two-ply neck collar for attachment to a neck opening of a garment body to help maintain a proper shape along the neck line. The two-ply neck collar may be made of either two separate strips of fabric material or one single and wider strip of fabric material can alternatively be used. The two-ply neck collar of the present invention utilizes a stitched portion residing underneath the upper edge portion of the neck collar to provide additional support to improve its ability to maintain proper shape along the neck line. The construction of the present neck collar is durable and provides comfort to the wearer.

In one embodiment, the two-ply neck collar is constructed of two strips of knitted fabric material. In this embodiment, the two strips of fabric material is sewn together along the top edge portions thereof such that one strip is lying flat against the other strip to form a joined unit. The joined unit is then opened flat to define two side edge portions with the stitched portion disposed extending longitudinally between to the two side edge portions. The joined unit is folded after being opened flat such that the two side edge portions are aligned with the stitched portion facing outward, after which, the two side edge portions are sewn together to form a tubular unit. Finally, the neck collar is formed by turning at least a portion of the tubular unit over the stitched portion.

In another embodiment, the two-ply neck collar is constructed of one strip of fabric material. In this embodiment, the one strip of fabric material is folded longitudinally to form a front section and a back section between a longitudinally extending fold line. Next, the folded strip is stitched along the fold line to form a stitched portion extending along the fold line. The stitched strip is then opened flat to define two side edge portions with the stitched portion disposed extending longitudinally between the two side edge portions. After the stitched strip has been opened flat, it is folded and stitched to affix the two side edge portions thereof together to form a tubular unit such that the stitched portion faces outwardly. The neck collar of the present invention may be formed by turning at least a portion of the tubular unit over the stitched portion.

DETAILED DESCRIPTION

Neck collar or neck band is frequently attached to shirts to help maintain proper shape along the neck line. The present invention provides for an improved neck collar which is more durable and is able to sustain a proper shape along the neck line longer than the traditional type of neck bands generally used with shirts.

Figure 1:
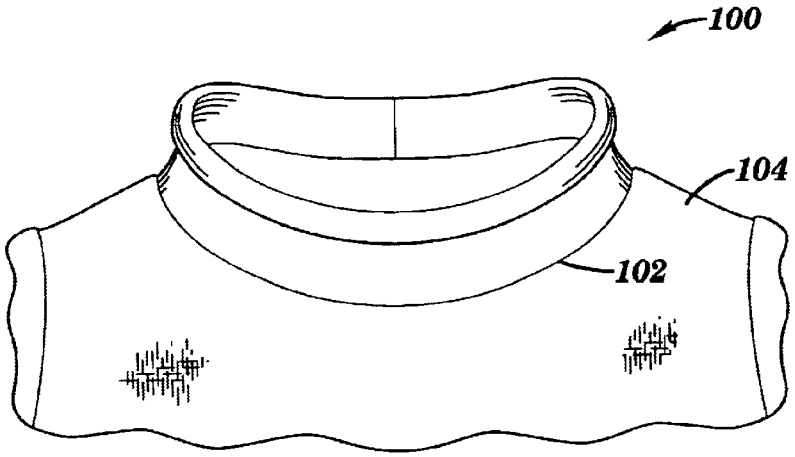
FIG. 1 is a diagrammatic perspective view of a two-ply neck collar according to one embodiment of the present invention attached to a shirt.
Figure 2:
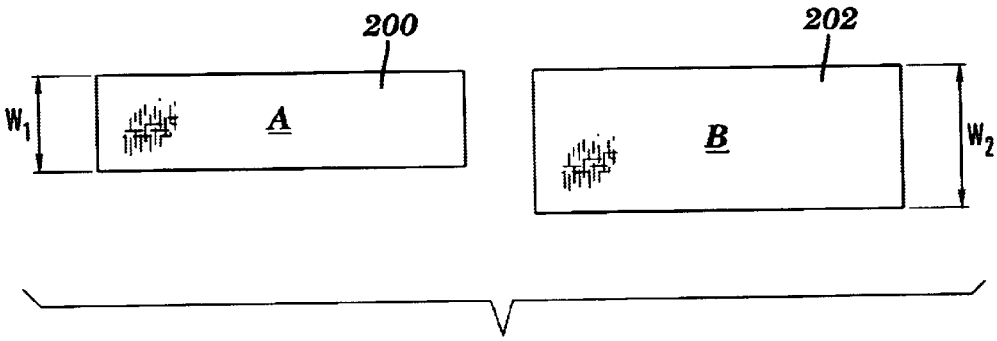
FIG. 2 is a top plan view of two strips of knitted fabric matieral from which the two-ply neck collar is constructed.

FIG. 1 shows an example of a two-ply neck collar 100 of the present invention attached to a neck opening 102 of a garment 104 such as T-shirts, sweat shirts and the like. In one embodiment, the neck collar 100 is constructed of two strips of knitted fabric material having a sufficient length to encircle the wearer's neck. As seen by referring to FIG. 2, the first strip (A) 200 of fabric material has a width (W1) which is less than the width (W2) of the second strip (B) 202 of fabric material. The strips 200, 202 of fabric material can be formed from any suitable stretchable material, such as, for example, a ribbed knit, spandex or jersey knit material. Because in this embodiment, the neck collar 100 is constructed of two separate strips of fabric material, the two strips 200, 202 can be formed from same material, or alternatively, the two strips 200, 202 can formed from a different material or color. For example, any of the following combination of fabric material may be utilized: a ribbed knit material and a jersey knit material; a set tape on ribbed knit material or a jersey knit material; and a set binding on a ribbed knit material or a jersey knit material.

Figure 3:
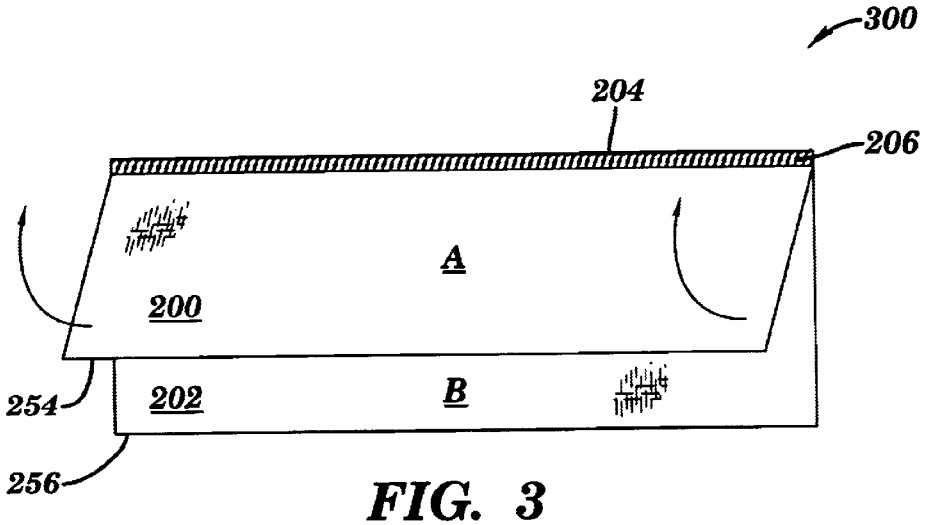
FIG. 3 is a perspective view of the two strips of fabric material stitched together along the top edge portions thereof to form a joined unit.
Figure 4:
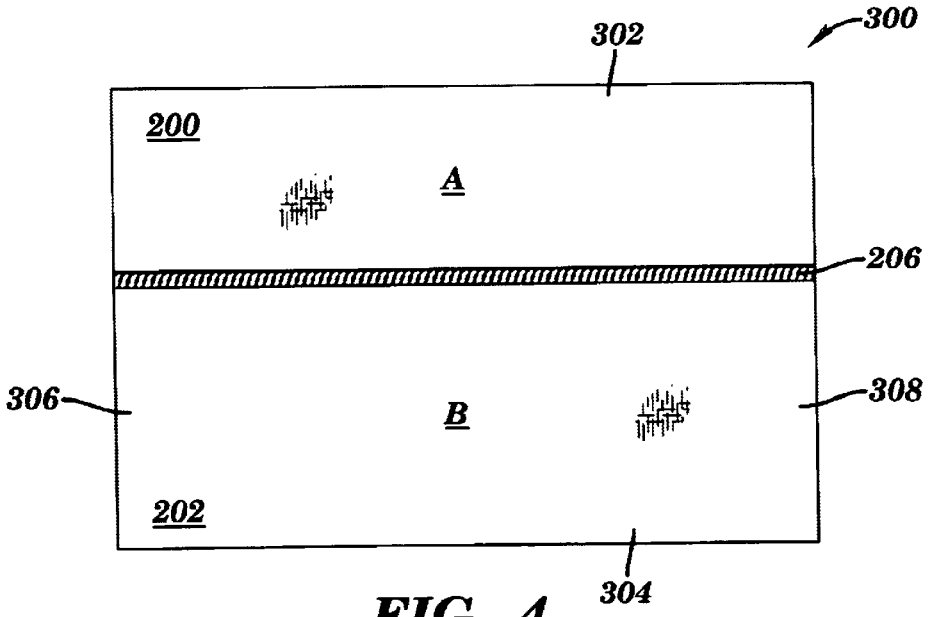
FIG. 4 is a top plan view of the joined unit opened flat to define a upper edge portion, a lower edge portion and two side edge portions with a stitched portion disposed extending longitudinally between the two side edge portions.
Figure 5:
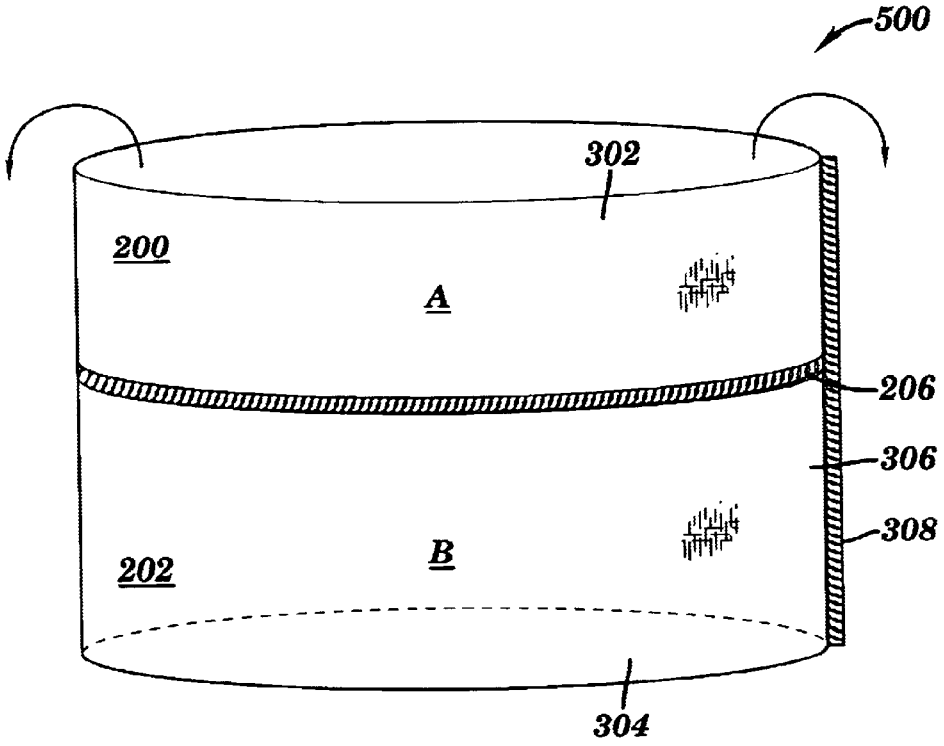
FIG. 5 is a perspective view of the joined unit stitched along the two side edge portions to form a tubular unit.

Referring to FIG. 3, the first strip A 200 is placed lying flat against the second strip B 202 with the top edges 204 of the two strips being aligned with respect to each other. Then, the two strips 200, 202 of fabric material are stitched together along the top edges 204 thereof to form a joined unit 300. The stitched portion is indicated by reference numeral 206. It should be noted that the two fabric pieces 200, 202 can be stitched together using any suitable stitching method including lock stitch (single or double), chain stitch (single or double), overlock stitch (three thread or four thread), safety stitch (five thread or six thread) and cover stitch. Turning now to FIG. 4, the joined unit 300 is opened flat by lifting the first strip A 202 upward from the second strip B 202 and rotating the entire joined unit 300 with respect to a vertical axis so that the stitched portion 206 is facing towards the viewer. The joined unit 300 laid open as depicted in FIG. 4 includes a upper section 302, a lower section 304 and two side edge portions 306, 308 with the stitched portion 206 disposed extending longitudinally between the two side edge portions 306, 308. Next, the joined unit 300 is folded such that the two side edge portions 306, 308 are aligned with the stitched portion 206 faces outward. After the joined unit has been properly folded, the two side edge portions 306, 308 are stitched together to form a tubular unit 500 as shown in FIG. 5. The two side edge portions 306, 308 can be stitched together using any convention and suitable method such as lock stitch, chain stitch, overlock stitch and the like.

Figure 6:
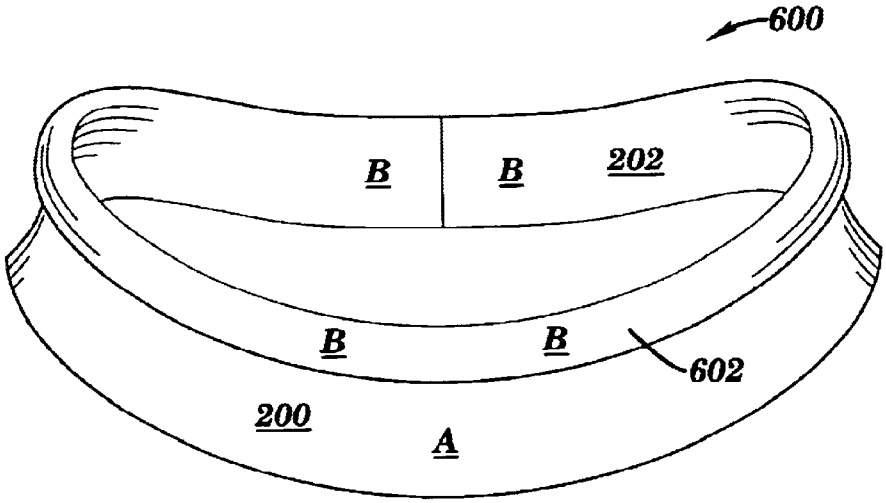
FIG. 6 is a perspective view of the two-ply neck collar of the present invention formed by turning the upper edge portion over the stitched portion.

Referring to FIG. 6, a neck collar 600 may be formed by flipped either the upper section 302 or the lower section 304 over the stitched portion 206 such that at least a part of the upper section 302 (i.e., first strip A 200) of the tubular unit is in overlapping relationship with the lower section 304 (i.e., second strip B 202) to form a circular neck collar 600. As seen by referring back to FIG. 3, when the two plies of fabric 200, 202 are aligned along the top edge 204, the bottom edges 254, 256 of the first and second fabric pieces 200, 202 are offset from each other, meaning that one fabric piece 200 is of shorter width than the other fabric piece 202. This is so that when the upper section 302 is flipped over the lower section 304 such that the bottom edges 254, 256 of the first and second fabric strips 200, 202 are displaced adjacent to each other, the stitched portion 206 is located underneath at or adjacent to the top peripheral edge 602 thereof. In this manner, the stitched portion 206 gives the neck collar 600 support around the peripheral edge 602 and thereby providing comfort to the wearer and increasing the strength and durability of the neck collar. The completed neck collar is now ready to be secured along an upper marginal edge of the neck opening of a shirt body.

Figure 7:
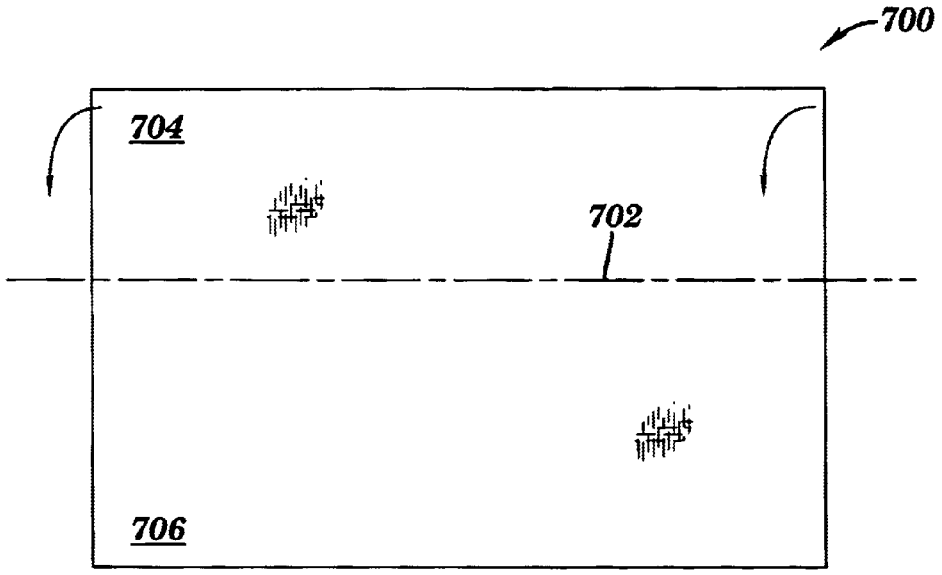
FIGS. 7–11 illustrate the steps involved in constructing a neck collar according to another embodiment of the present invention.
Figure 8:
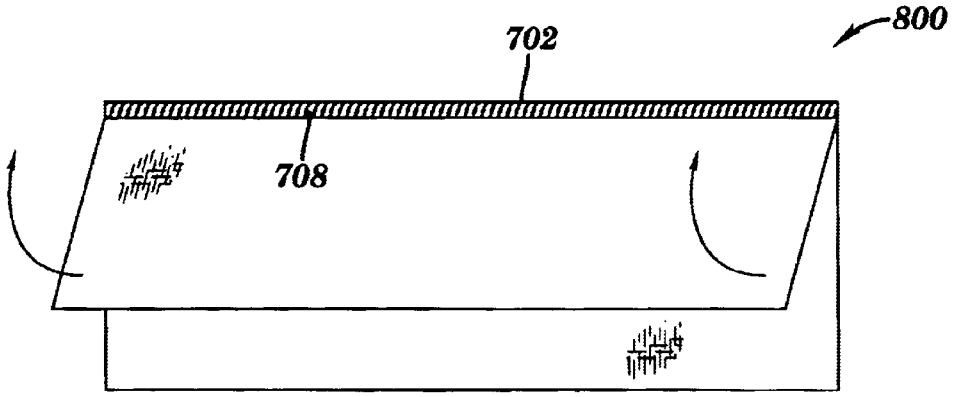
Figure 9:
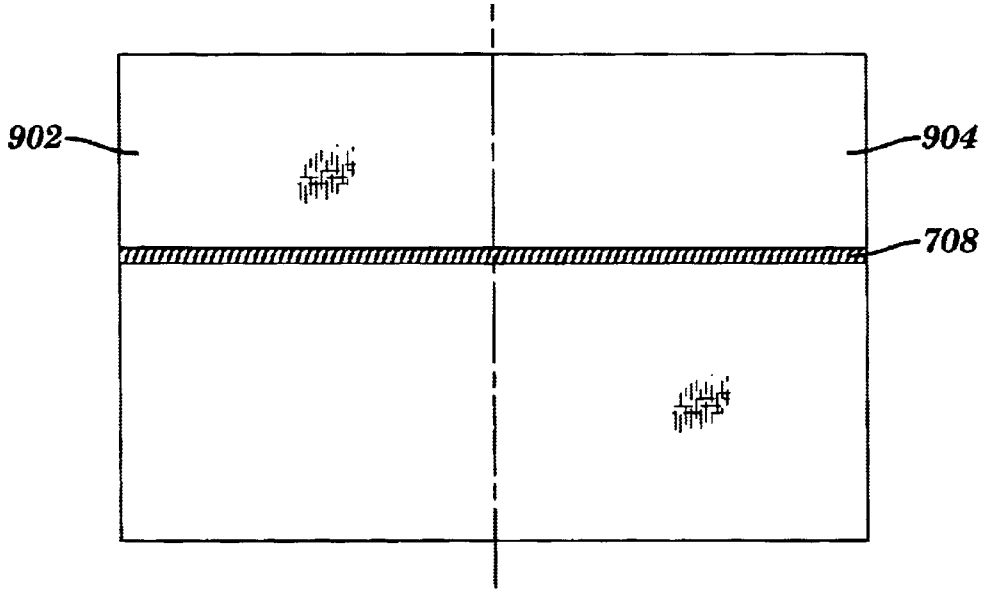
Figure 10:
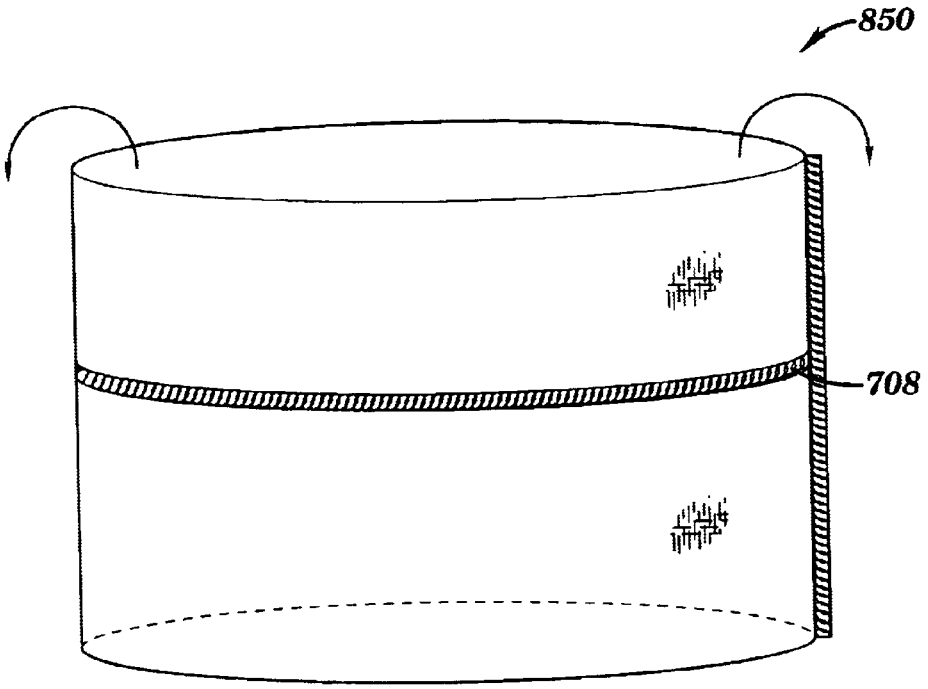
Figure 11:
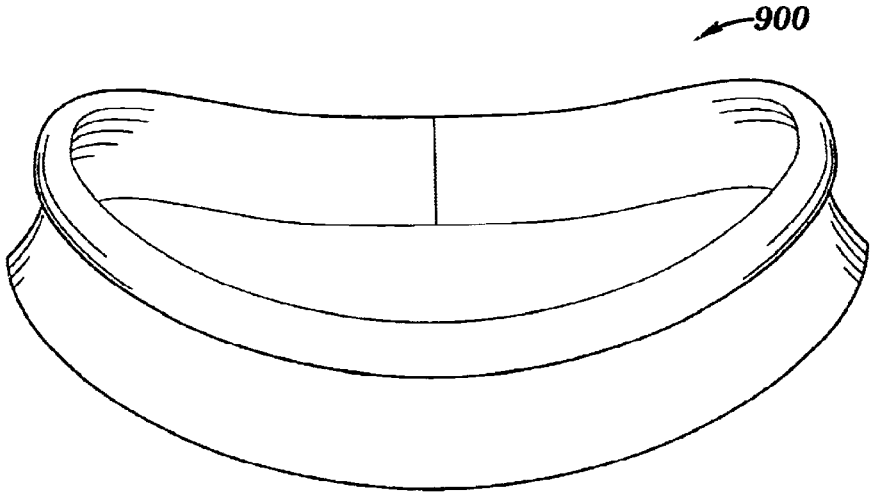

FIGS. 7–11 illustrate steps involved in constructing a neck collar according to another embodiment of the present invention. In this embodiment, only one strip 700 of fabric material is utilized in making the two-ply neck collar. As shown in FIG. 7, the one strip 700 of fabric material is folded longitudinally to form a front section 704 and a back section 706 between a longitudinally extending fold line 702. The fold line 702 is selected so that when the strip 700 is folded longitudinally the lower edge of the front section 704 is offset from the lower edge of the back section 706. Next, the folded strip is stitched along the fold line 702 to form a stitched portion 708 extending along the fold line, as depicted in FIG. 8. The stitched strip 800 is then opened flat to define two side edge portions 902, 904 with the stitched portion 708 disposed extending longitudinally between the two side edge portions as seen by referring to FIG. 9. After the stitched strip has been opened flat, it is folded and stitched to affix the two side edge portions 902, 904 thereof together to form a tubular unit 850 such that the stitched portion 708 faces outwardly as shown in FIG. 10. Finally, a neck collar 900 according to this embodiment is formed by turning at least a portion of the tubular unit 800 over the stitched portion 708 as shown in FIG. 10.

While the foregoing preferred embodiments of the invention have been described and shown, it is understood that variations and modifications, such as those suggested and others within the spirit and scope of the invention, may occur to those skilled in the art to which the invention pertains. For example, although the illustrated neck collars are described and shown in terms of a round neck line, it should be understood by those skilled in the art that the neck collar construction of the present invention can be easily modified to form other styles of neckline such as V-neckline, square neckline, boat-shaped neckline, turtle-neck type neckline, cuff and the like. The scope of the present invention accordingly is to be defined as set forth in the appended claims.

What is claimed is:

1. A neck collar comprising:

a first strip of fabric material and a second strip of fabric material, each strip having a top edge portion;

a first stitching for affixing said top edge portion of said first strip of fabric material to said top edge portion of said second strip of fabric material such that one strip is lying flat against the other strip to form a joined unit, wherein said joined unit includes two side edge portions when said joined unit is opened flat with a stitched portion disposed extending longitudinally between said two side edge portions; and a second stitching for affixing said two side edge portions of said joined unit together to form a tubular unit such that said stitched portion extends along an outer face of said tubular unit, wherein said neck collar is formed by turning at least a portion of said tubular unit over said stitched portion, wherein one of the strips of fabric material forming an inner layer of the neck collar extends over the stitched portion such that a longitudinal line formed between the first and second strips of fabric material is disposed, along an outer layer of the neck collar, a defined distance from a top peripheral edge of the neck collar.

2. The neck collar of claim 1, wherein said neck collar is attached to a neck opening of a shirt body to help maintain a proper shape along the neck line.

3. The neck collar of claim 1, wherein one of said strips of fabric material has a width which is less than the width of the other strip of fabric material.

4. The neck collar of claim 1, wherein each of said strips of fabric material has a length to encircle the wearer's neck.

5. The neck collar of claim 1, wherein the neck collar is formed by turning at least a portion of the tubular unit over the stitched portion such that an outer edge of the stitched portion points towards the top peripheral edge of the neck collar.

6. A garment comprising:

a garment body having a neck opening;

a first strip of fabric material and a second strip of fabric material, each strip having a top edge portion;

a first stitching for affixing said top edge portion of said first strip of fabric material to said top edge portion of said second strip of knitted fabric material such that one strip is lying flat against the other strip to form a joined unit, wherein said joined unit includes side edge portions when said joined unit is opened flat with a stitched portion disposed extending longitudinally between said two side edge portions;

a second stitching for affixing said two side edge portions of said joined unit together to form a tubular unit such that said stitched portion extends along an outer face of said tubular unit, wherein a neck collar is formed by turning at least a portion of said tubular unit over said stitched portion, wherein one of the strips of fabric material forming an inner layer of the neck collar extends over the stitched portion such that a longitudinal line formed between the first and second strips of fabric material is disposed, along an outer layer of the neck collar, a defined distance from a top peripheral edge of the neck collar; and a third stitching for affixing said neck collar to said neck opening of said garment body.

7. The garment of claim 6, wherein the neck collar is formed by turning at least a portion of the tubular unit over the stitched portion such that an outer edge of the stitched portion points towards the top peripheral edge of the neck collar.

8. The garment of claim 6, wherein one of said strips of fabric material has a width which is less than the width of the other strip of fabric material.

9. A neck collar comprising:

a strip of knitted fabric material being folded longitudinally to form a front section and a back section between a longitudinally extending fold line;

a first stitching for affixing said front section to said back section adjacent to said longitudinally extending fold line to form a stitched portion, said strip of knitted fabric material having two side edge portions when said strip of knitted fabric material is opened flat with said stitched portion disposed extending longitudinally between said two side edge portions; and a second stitching for affixing said two side edge portions of said strip of knitted fabric material together to form a tubular unit such that said stitched portion extends along an outer face of said tubular unit, wherein said neck collar is formed by turning at least a portion of said tubular unit over said stitched portion.

10. The neck collar of claim 9, wherein the neck collar is formed by turning at least a portion of the tubular unit over the stitched portion such that an outer edge of the stitched portion points towards the top peripheral edge of the neck collar.

11. The neck collar of claim 9, wherein said neck collar is attached to a neck opening of a shirt body to help maintain a proper shape along the neck line.

12. The neck collar of claim 9, wherein one of said strips of knitted fabric material has a width which is less than the width of the other strip of knitted fabric material.

13. A method for making a neck collar from first and second strips of fabric material comprising the steps of:

aligning a top edge portion of said first strip of fabric material with a top edge portion of said second strip of fabric material such that one strip is lying flat against the other strip;

sewing said first and second strips of fabric material together along said top edges thereof to form a joined unit;

opening flat said joined unit after being sewn together along the top edges thereof which includes two side edge portions with a stitched portion disposed extending longitudinally between said two side edge portions;

folding said joined unit such that one of said side edge portions is aligned with the other side edge portion with said stitched portion of said joined unit facing outwardly; and sewing said side edges of said joined unit together to form a tubular unit; and flipping at least a portion of said tubular unit over said stitched portion to form said neck collar, wherein one of the strips of fabric material forming an inner layer of the neck collar extends over the stitched portion such that a longitudinal line formed between the first and second strips of fabric material is disposed, along an outer layer of the neck collar, a defined distance from a top peripheral edge of the neck collar.

14. The method of claim 13, wherein the neck collar is formed by turning at least a portion of the tubular unit over the stitched portion such that an outer edge of the stitched portion points towards the top peripheral edge of the neck collar.

15. The method claim 13, wherein said neck collar is attached to a neck opening of a shirt body to help maintain a proper shape along the neck line.

16. The method of claim 3, wherein one of said strips of fabric material has a width which is less than the width of the other strip of fabric material.

17. A method of making a two-ply neck collar from one strip of fabric material comprising the steps of:

folding said one strip of fabric material to form a front section and a back section divided by a longitudinally extending fold line;

sewing along said longitudinally extending fold line of said folded strip of fabric material to form a stitched portion;

opening flat said strip of fabric material after being sewn along said fold line to define two side edge portions with said stitched portion disposed extending longitudinally between said two side edge portions;

folding said strip of fabric material after being opened flat such that one of said side edge portions is aligned with the other side edge portion with said stitched portion facing outward;

sewing said side edges of said strip of fabric material together to form a tubular unit; and flipping at least a portion of said tubular unit over said stitched portion to form said neck collar.

18. The method of claim 17, wherein the neck collar is formed by turning at least a portion of the tubular unit over the stitched portion such that an outer edge of the stitched portion points towards the top peripheral edge of the neck collar.

19. The method of claim 17, wherein said neck collar is attached to a neck opening of a shirt body to help maintain a proper shape along the neck line.

20. The method of claim 17, wherein one of said strips of knitted fabric material has a width which is less than the width of the other strip of knitted fabric material.

* * * * *